US007144288B2

(12) United States Patent
Hitzschke et al.

(10) Patent No.: US 7,144,288 B2
(45) Date of Patent: Dec. 5, 2006

(54) PROCESS FOR PRODUCING A DISCHARGE LAMP BY SOFTENING A SUPPORT ELEMENT OUTSIDE OF A DISCHARGE CHAMBER

(75) Inventors: Lothar Hitzschke, Munich (DE); Frank Vollkommer, Buchendorf (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 557 days.

(21) Appl. No.: 10/398,585

(22) PCT Filed: Jun. 26, 2002

(86) PCT No.: PCT/DE02/02342

§ 371 (c)(1),
(2), (4) Date: Aug. 29, 2003

(87) PCT Pub. No.: WO03/017312

PCT Pub. Date: Feb. 27, 2003

(65) Prior Publication Data

US 2005/0260917 A1 Nov. 24, 2005

(30) Foreign Application Priority Data

Aug. 8, 2001 (DE) ..... 101 38 925

(51) Int. Cl.
*H01J 9/00* (2006.01)
*H01J 9/24* (2006.01)

(52) U.S. Cl. ..... 445/25; 445/40; 445/43; 313/586; 313/625; 65/34; 65/36

(58) Field of Classification Search ..... 445/25
See application file for complete search history.

(56) References Cited

U.S. PATENT DOCUMENTS

| | | | | |
|---|---|---|---|---|
| 6,176,753 | B1 | 1/2001 | Pong et al. | |
| 6,901,772 | B1 * | 6/2005 | Eberhardt et al. | 65/34 |
| 6,976,898 | B1 * | 12/2005 | Hitzschke et al. | 445/25 |
| 7,015,644 | B1 * | 3/2006 | Hitzschke et al. | 313/586 |
| 2002/0163296 | A1 | 11/2002 | Hitzschke et al. | |
| 2002/0163311 | A1 | 11/2002 | Hitzschke et al. | |

FOREIGN PATENT DOCUMENTS

| | | |
|---|---|---|
| DE | 199 36 863 | 8/1999 |
| DE | 198 17 478 | 9/2000 |

* cited by examiner

*Primary Examiner*—Sikha Roy
(74) *Attorney, Agent, or Firm*—Robert F. Clark

(57) ABSTRACT

A process for producing a discharge lamp which is designed for dielectric barrier discharges in which, during a filling step, before the discharge chamber is closed, a part of the discharge vessel is held in a raised position by a support element which is then at least partially softened, in order for the part which is being held in a raised position to be lowered. The support element lies outside the discharge chamber.

8 Claims, 3 Drawing Sheets

PROCESS FOR PRODUCING A DISCHARGE LAMP BY SOFTENING A SUPPORT ELEMENT OUTSIDE OF A DISCHARGE CHAMBER

TECHNICAL FIELD

The present invention relates to a process for producing a discharge lamp which is designed for dielectric barrier discharges.

PRIOR ART

Lamps of this type which are designed for dielectric barrier discharges are known per se. A discharge chamber of a discharge vessel is used to hold a discharge medium, often xenon (Xe). Dielectric barrier discharges can be produced in the discharge medium, i.e. inside the discharge chamber, using a set of electrodes. The set of electrodes may be provided inside or outside the discharge chamber. It is necessarily at least partially separated from the discharge medium by a dielectric layer, which may also be formed by a discharge vessel wall.

What are known as flat radiators, in which the discharge vessel has a base plate and a cover plate, which are connected by a frame which runs in the region of the outer edge of the plates and may also form part of one of the two plates, are known as a special example of discharge lamps. The present invention is not restricted to the flat radiator form. However, it is known in this structural form to provide support elements between the plates, which are used to shorten the effective bending lengths and to mechanically stabilize the discharge vessel. This is important on account of the in some cases relatively large sizes of the flat radiators, in particular in the case of backlighting of large-area display devices, and also on account of the vacuum which often prevails in the discharge medium. However, the present invention is not restricted to discharge lamps having support elements of this type.

Finally, it is known from DE 198 17 478 to design these support elements in a particular way, namely to provide them with a part which softens at the temperature which is applied during a filling step. The filling step may be carried out, for example, in a vacuum furnace and takes place at elevated temperature, in order to desorb adsorbates on the discharge chamber inner walls and/or to allow softening of the abovementioned parts of the support elements. Moreover, according to the procedure which is described in the above document, a sealing surface which is provided at the frame of the flat radiator may likewise be provided with a material which softens to such an extent that this sealing surface, when the corresponding parts are brought into contact with one another, produces a sealed connection. In this way, the discharge chamber can be automatically closed during the filling step. This is because the filling step is used to dilute the residual atmosphere in the discharge chamber as much as possible and to fill the chamber with the desired discharge medium. According to the teaching of this document, the support elements in this case have the function of initially holding the cover plate of the flat radiator in a raised position above the frame, so that an opening for the filling of the discharge chamber is kept clear between the underside of the cover plate and the upper side of the frame. If the abovementioned parts of the support elements are sufficiently softened at a suitable temperature, the cover plate is lowered under the force of gravity, since these support-element parts are pressed flat. As a result of the underside of the cover plate coming to bear against the sealing surface on the frame, it is possible to achieve a sealed connection and therefore the desired enclosing of the discharge medium in the discharge chamber and the closure thereof.

Soldering glass materials or similar substances are often used both for the sealing surface and for the softening parts of the support elements. With regard to the materials which can be used, the structure of the support elements, the typical temperatures and the appropriate viscosities of the various parts of the support elements, reference is made to the content of disclosure of the abovementioned document, which is incorporated in the present application by reference.

SUMMARY OF THE INVENTION

Working on the basis of the above prior art, the present invention is based on the problem of providing a production process for a discharge lamp which is designed for dielectric barrier discharges which is improved with regard to the filling step. The invention relates to a production process for a discharge lamp of this type, in which, during a filling step which precedes closing of the discharge vessel, one of at least two parts of the discharge vessel is held in a raised position by a support element, which support element is at least partially softened by the application of heat in order for the discharge chamber to be closed, with the result that the part of the discharge vessel which has been held in a raised position is lowered, but unlike in the prior art the support element is arranged completely outside the discharge chamber while the discharge-vessel part is being held in a raised position.

Preferred embodiments are given in the subclaims.

The support elements used for lowering of the part of the discharge vessel which has been held in a raised position often include a part which softens during the filling step and which may lead to disruptive impurities in the residual gas atmosphere in the discharge chamber. These impurities may occur on account of the higher temperatures used during the filling step and also during the service life of the lamp. In particular, what are known as soldering glass materials may be used for the softening parts. These materials may, for example, be glass powders held by organic binders. This means that suitable viscosities can be reached even at relatively low temperatures. However, the binder materials entail inevitable escapes of residual gases, which interfere with the purity of the residual gas atmosphere.

The problems described above are particularly pronounced in parts which have simply been preshaped and in addition to the glass powder also contain the organic binder still in its original form. However, the disruptive escape of gases also occur in the case of presintered parts, in which only residues of binder remain, although to a reduced extent.

In principle, however, it is possible to use glass grades which soften at the appropriate temperatures in pure form, for example parts made from pure SF6 glass. These completely binder-free parts do not inherently lead to disruptive escapes of gases. Nevertheless, they have drawbacks, since they may disrupt the geometry of the discharge chamber, particularly in the case of certain shapes of the support elements. For example, it may be desirable for support elements which rest with a point or a sharp edge on one of the two plates to be used, in which case the discharge chamber is to be utilized all the way into the vicinity of the contact between the point or edge and the corresponding plate or certain optical properties are to be ensured. In this case, the softened parts would be pressed away sideways from the point or edge and would block or disrupt part of the discharge chamber.

The invention is based on the discovery that these softening parts are basically only indispensable for holding the discharge vessel part in a raised position. The supporting functions in the discharge chamber itself can, if they are in fact required, also be performed without softening parts of this type, even though the cited prior art, with a view to uniformity of the installation, recommends softening elements of this type in particular with a view to this supporting function. However, the invention works on the basis that the purity of the residual gas atmosphere is of primary importance and any support elements within the discharge chamber can be produced with sufficient accuracy to make it possible to dispense with softening parts, or at least provide smaller numbers of such parts, within the discharge chamber. Therefore, the invention is also directed at discharge lamps in which there are no support elements whatsoever inside the discharge chamber.

The discharge vessel part can successfully be held in a raised position by means of support elements which are completely outside the discharge chamber and soften completely or partially during the filling step, in which case the softening parts only lead to gases escaping outside the discharge chamber, so that they also have no adverse effect on the discharge chamber. An arrangement completely outside the discharge chamber is in particular also to be understood as meaning that, when the discharge vessel is closed, the softening parts lie outside the edge of the discharge chamber and are not in contact with the discharge chamber. Therefore, they are to be arranged in particular outside a frame of, for example, a flat radiator. This is what the application means by the term "completely outside".

If the flow in, for example, the vacuum furnace in which the filling step is carried out is sufficiently strong or directed in a suitable way, the discharge chamber itself is scarcely affected by the escape of gases from soldering gas materials or the like which lie outside. In particular, the discharge chamber itself is no longer affected by further escapes of gases from the softening parts which now lie outside even after the discharge vessel part has been lowered. This is advantageous since the highest temperatures occur precisely during this lowering operation and also continue to obtain for a certain time, on account of the inevitable inertia.

It should be noted that the invention is not restricted to sealing the two plates with respect to one another or with respect to a frame in the manner described above, using soldering glass materials or other softening materials, during the filling step. However, this procedure does represent a preferred variant. In this case, the contamination of the discharge medium by the softening material used plays a slightly lesser role on account of the fact that the surface of this seal which is exposed to the discharge medium can be kept very small. However, the softening parts of the support elements inevitably have a certain volume and therefore also a certain surface area. Finally, they are to allow movement of the plate which is held in a raised position over a macroscopic distance.

Moreover, the abovementioned flat radiators form a preferred application of the invention. In this case, the support element, which according to the invention lies outside the discharge chamber, having the softening part (or a plurality of support elements of this type) may lie outside the frame but may still quite easily be arranged between the plates. It is also possible for the plate to be lengthened suitably, these lengthened sections then being removed again, for example by being broken off, in a subsequent step of the production process. In particular, the support element(s) according to the invention may merely be auxiliary means used in the process, which do not play any role in the finished discharge lamp and therefore are separated again from the discharge lamp during production.

The preferred structure of the support elements comprises at least two parts, of which the softening part rests on the plate which lies at the bottom during the filling step and supports the part which does not soften on top of it. In this way, by way of example, the contact surface between the upper part and the upper plate, which is preferably the cover plate, can be kept small, so that the radiation of light is subjected to little disruption.

Of course, in the production process which forms the subject matter of the invention, it is preferable to completely dispense with softening parts within the discharge chamber, if this phrase is assumed not to encompass the sealing surface of the frame or any other sealing surface of the discharge vessel. Moreover, there should preferably not be too many of the support elements according to the invention used outside the discharge chamber, since it is possible that escapes of gas outside the discharge chamber may also to a certain extent impair the residual gas atmosphere in the discharge chamber. Moreover, a small number of softening support element parts has the advantage that the weight of the discharge vessel part which is to be lowered is distributed over this small number of softening parts. This requires little or no additional weight to be applied to the discharge vessel part which is to be lowered. However, the elimination of parts which provide additional weight leads to more rapid temperature changes during heating and cooling and to a more homogeneous temperature distribution and to better utilization of space. It should be noted that the number of softening parts can even be used to adapt to the effective weight which presses down the discharge vessel part which is to be lowered. Specifically, if a plurality of discharge vessels are stacked on top of one another, this effective weight is much greater in discharge vessels which lie towards the bottom of the stack than in those which lie further up.

Advantageously, at most four support elements should be designed and used in this way. By way of example, these four support elements may be arranged in the four corners of a flat radiator discharge vessel with a rectangular plate shape, so that the plate which is to be held in a raised position is supported in each case in the region of its outer corners. Basically, however, three support elements are also sufficient to support the area of a plate. Finally, it is also possible for the plate already to be resting on the frame at one corner or edge and in this case to be held in a raised position by means of only two or even just one support element. In this case, the opening which is available for the filling of the discharge chamber is no longer on all sides, but this does not necessarily cause problems. In particular, this opening may be designed to be slightly higher than in the case of an opening on all sides, so that a sufficient cross section is available.

In the invention, a variant in which the part which is used to hold the plate in a raised position is softened in its entirety, i.e. in other words the element arranged between the cover plate and the base plate is softened in its entirety, may be advantageous. In this case, one of the two plates may be shaped in such a way that the plate itself in part has the function of a support element. However, in this variant, in addition to the two plates and the softening support elements (support element parts) which lie between them, there are no further separate support element parts which do not soften (at least not at the support element locations which are used to hold the plate in a raised position).

With regard to the design of support elements which are integrated in the plates, in particular in the cover plates, reference is made to two earlier patent applications in the name of the same applicant, namely DE 100 48 187.6 and DE 100 48 186.8, the content of disclosure of which is hereby incorporated by reference. Specifically, the support elements may be designed as single-piece components of the cover plate.

If the support projections which lie outside the discharge chamber are designed to be slightly less deep or lower than those inside the discharge chamber, the softening parts can be inserted in between at these locations. However, in this case the positioning outlay is restricted to the relatively small number of these locations in accordance with the invention.

Moreover, the support projections according to the invention which lie outside the discharge chamber may also, as explained in the cited applications, run in the manner of ribs i.e. may simply taper in one dimension. However, it is preferable for them also to taper in a second dimension i.e. to run substantially to a point. In this case, the softening element may be provided with an opening, into which the point of an associated support projection is inserted, so that the fitting of the cover plate to these softening elements is somewhat self-aligning or at any rate can take place relatively reliably. The cavities which are possible in the softening elements should preferably be provided with an opening, so that it is impossible for any impurities to be retained. For this purpose, by way of example, the boundary surfaces of sections of tube may have recesses or may deviate in the shape of the support projections. There may also be lateral holes. Moreover, pieces of tube could be axially slotted.

In the case of the support projections within the discharge chamber, which are not intended to be used in combination with a softening part for holding the plate in a raised position, it is preferable for there to be only touching contact between support projection and base plate, which is often sufficient for the stabilizing effect, in particular if the discharge medium is at a subatmospheric pressure.

The preferred material for the softening elements, incidentally, substantially comprises SF6 glass. If the viscosity of the softening parts is not or should not be very low or if the part which is to be lowered is very light, the part which is held in a raised position may also, as mentioned above, be weighted in order to assist with the lowering operation.

DESCRIPTION OF THE DRAWINGS

In the text which follows, the invention is explained in more detail with reference to an exemplary embodiment: The features which are illustrated may also be pertinent to the invention in other combinations.

In the drawing:

In connection with FIG. 1, reference is made first of all to FIG. 3 of each of the two prior applications which have been cited. For the sake of clarity, the same reference numerals have been used in the present applications where they refer to similar components.

FIG. 1 shows a diagrammatic plan view of a structure of a cover plate (3 in FIGS. 2 and 3) and a base plate (4 in FIGS. 2 and 3), which completely correspond to the structure described in the cited applications, apart from the details which are explained below.

Figure 1:
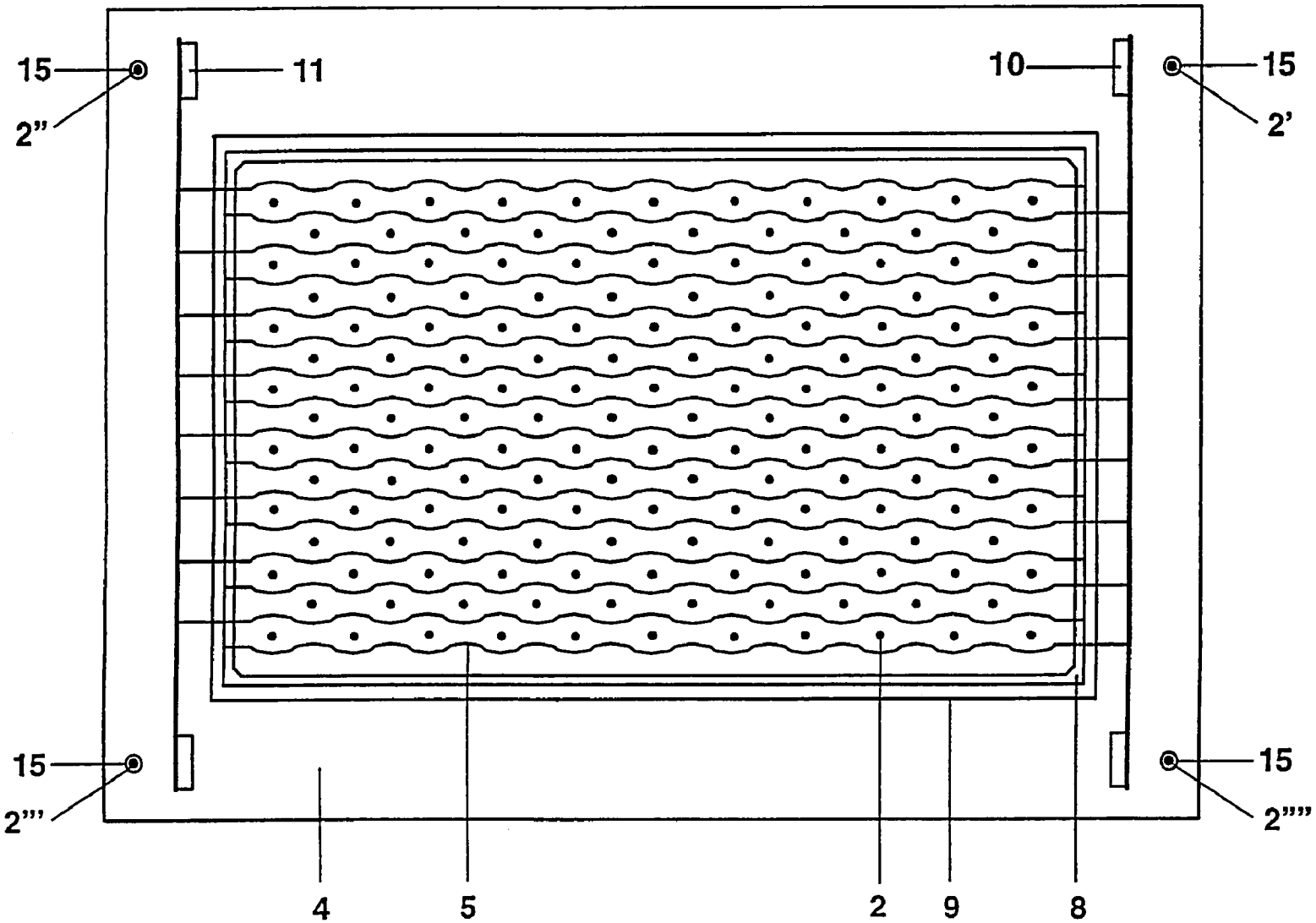
FIG. 1 shows a diagrammatic plan view of a flat radiator discharge lamp according to the invention, with contact locations between the support elements and the base plate indicated diagrammatically and softening parts of the support elements in the corners.
Figure 2:
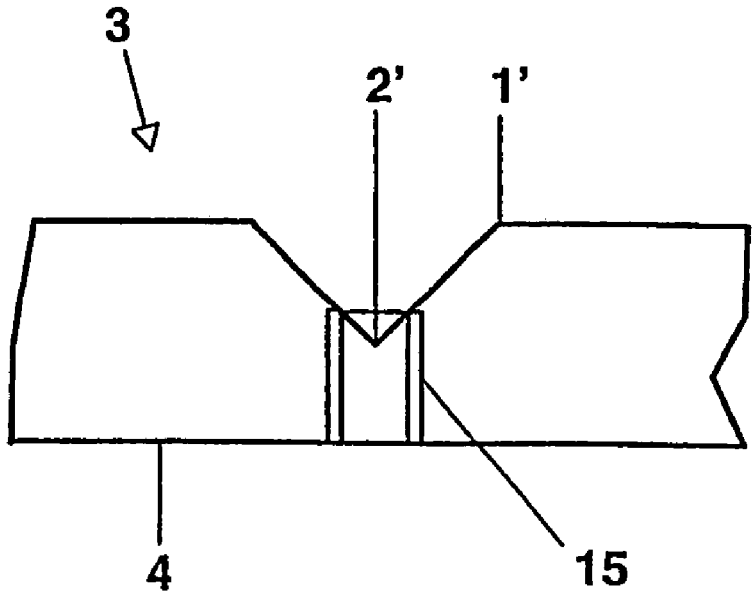
FIG. 2 shows a diagrammatic side view of a support element from one of the corners in FIG. 1, before softening of the part provided for this purpose.

The cover plate 3 and the base plate 4 are separated in the outermost corner regions by means of pieces of tube 15, which can easily be seen from FIG. 2, the substantially circular cross section of which is indicated from above in FIG. 1, which are produced from SF6 glass and on which the outermost support projections rest in the corners outside the rectangular format of the flat radiator. The support projections have a circular shoulder, which is denoted by 1'–1'''', in the planar parts of the cover plate 3 and, from there, extend tapering conically, with a point 2'–2'''' at the lower end, towards base plate 4. The points 2'–2'''', when projected onto the plate planes, form the centrepoints of the circles 1'–1''''. The cover plate 3 is in this case a thermoformed glass panel, the upper side of which substantially matches the lower side in terms of its contours. In this case, therefore, the support projections correspond to the other support projections within the discharge chamber, i.e., as seen in the plan view shown in FIG. 1, within the frame 8, which is described below. The details of this arrangement have already been explained in the two earlier applications which have been cited and therefore require no further description in the present document.

In FIG. 1, the outer edge region is shown on a slightly exaggerated scale, for the sake of clarity. In actual fact, it will be desired to keep the proportion of the surface of the flat radiator which extends beyond the useable light-generating surface as small as possible.

In FIG. 1, 5 denotes electrode strips, which in combination construct a complete set of electrodes for dielectric barrier discharges, both the anodes and the cathodes being dielectrically coated and also having no other differences from one another. The electrode strips 5 are each alternately led to a right-hand terminal 10 and a left-hand terminal 11 and may be connected to an electronic ballast via these terminals. Discharge regions are formed in each case in the closest adjacent sections of electrode strips 5 which lie next to one another, so that they lie in the discharge chamber sections which are denoted by 6 in FIG. 3. In this connection, reference is also made to the earlier applications which have been cited. This also applies to the shape of the electrode strips, which is explained in more detail in those applications. However, it can be seen that the support projections are each surrounded by identical arrangements of adjacent discharge regions, and vice versa (with the exception of the edge regions) and that by means of the arrangement illustrated in FIG. 1 it is possible to find various lines along which discharge regions and support projections alternate. In this connection too, reference is made to the prior applications. It should be noted that in FIG. 1, the circular shoulders 1 are not shown for the sake of clarity, and consequently the support projections are represented only by the points 2.

In FIG. 1, reference numeral 8 shows a frame-like structure, which in this exemplary embodiment does not form a separate frame, but rather is likewise a thermoformed projection of the cover plate 3. However, this projection is designed as a rib and not as a cone which tapers to a point. The width of the frame rib 8 is used to produce a gastight connection to the base plate 4 which, as has already been explained, can be produced by means of a soldering glass. The line 9 which lies further to the outside shows the outer limit of the frame, i.e. to a certain extent corresponds to the circular shoulder 1 at the support projections.

Figure 3:
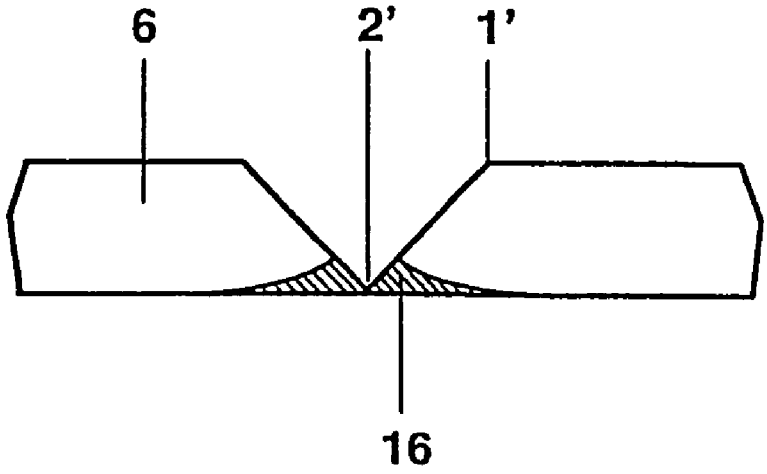
FIG. 3 shows a view corresponding to FIG. 2 after softening of this part.

If the lamp is to be filled before the closing operation produced by gastight adhesive bonding or soldering of the frame 8 to the base plate 4, it is "jacked up" in the state which is sketched in FIGS. 1 and 2 as a result of the outermost support projections 1'–1"", 2'–2"" being fitted to the pieces of pipe 15 in the corners. The tube projections 15 have a lateral slot which is not shown in the drawing, so that its interior is also encompassed. During the filling step, the pieces of tube 15 hold the cover plate 3 in a raised position at a height of approximately 2.5 mm, corresponding to their vertical length, so that the entire discharge chamber can be flooded with the desired discharge medium. Then, the vacuum furnace used for this purpose in the present example can be heated up until the softening point of the SF6 glass which forms the pieces of tube 15 is reached, whereupon the pieces of tube 15 are compressed by the weight of the cover plate 3, to which a weight may have been added if necessary, to form an irregular accumulation of materials 16, so that ultimately the situation illustrated in FIG. 3 is reached. By now, all that remains of the piece of tube 15 from FIG. 2 is an amorphous, small lump which additionally bonds the support projection 1',2' to the base plate 4.

In the example illustrated, the point 2' in FIG. 3 comes to bear against the base plate 4 (the same applies to 2"–2""). This does not necessarily have to be the case. The support projections which are designed for the softening pieces of tube 15 may also have slightly shorter vertical dimensions, so that the tip 2' does not have to completely displace the material 16 beneath it, but the pointed shape means that this displacement does not cause any particular problems. The situation may be different in the case of support projections in rib form.

Figure 4:
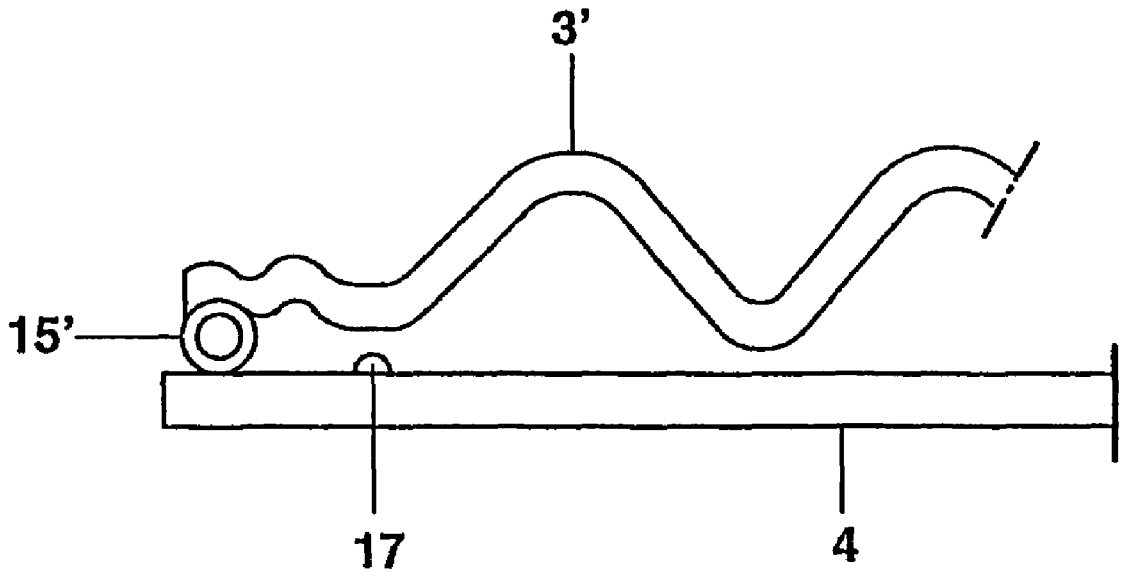
FIG. 4 shows an illustration which is similar to that shown in FIG. 2 but relates to a further exemplary embodiment.
Figure 5:
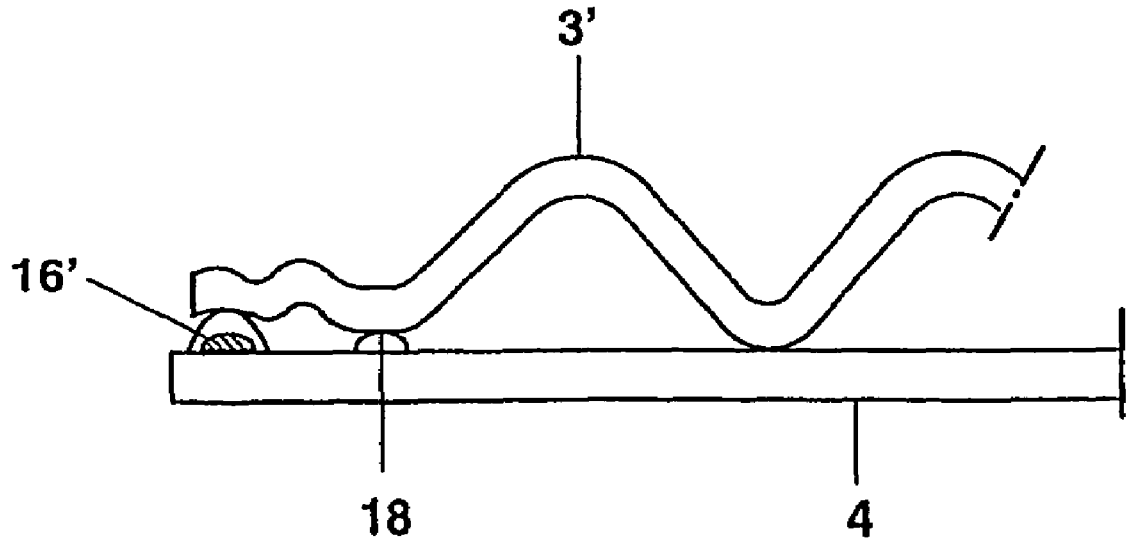
FIG. 5 shows an illustration corresponding to that shown in FIG. 4 after softening of the support element shown in FIG. 4.

FIGS. 4 and 5 show a second exemplary embodiment. In this case too, 4 denotes a flat base plate, on which, however, a slightly modified cover plate 3 is to come to rest. This cover plate 3' has a "studded structure", in connection with which reference is made to applications 100 48 187.6 and 100 48 186.8, which have already been cited. In FIG. 4, before the end of the filling step the outer region of the cover plate 3' rests on a piece of SF6 glass tube 15', the axial direction of which lies parallel to the plate. A matching, complementary bulge at the outermost edge of the cover plate 3' makes it easy for the latter to be placed onto the piece of tube 15' or three or four such pieces of tube 15'. As a result, corresponding opening gaps are formed between the cover plate 3' and the base plate 4 over the majority of the outer periphery of the discharge vessel.

The piece of SF6 glass tube 15' softens at the appropriate temperature and sinks down, so that an amorphous accumulation of materials 16', which is indicated in FIG. 5, remains. The discharge chamber is sealed by means of a bead of soldering glass 17 which seals off the frame which is integrated in the cover plate 3' at this location, and likewise softens when the cover plate 3' is lowered and thereby ensures a seal 18 (FIG. 5). The particular feature of the piece of glass tube 15', which in this case has a wall thickness of 0.3 mm for a diameter of 3 mm, is that it does not have to be cut precisely to length in order to predetermine the correct vertical dimensions. Rather, in this case material bought by the meter, which has been cut to length inaccurately, can be used. Moreover, thin-walled tubes with relatively small quantities of material are sufficient, the opening in the tube being produced by the fact that its axis is located parallel to the plates, without it being necessary to form a slot. The integrally formed holding on behalf of the cover plate 3' makes the structure illustrated in FIG. 4 relatively stable and able to withstand vibrations. Of course, as an alternative to the tube 15', it would also be possible to use a tube with a different cross section or a solid rod. The material 16' which has been baked or melted to the base plate 4 and the cover plate 3' (FIG. 5) is also responsible for additionally stabilizing the join between the two plates 3' and 4' independently of the seal 18 of the integrated frame.

The invention claimed is:

1. A process for producing a flat radiator discharge lamp which is designed for dielectric barrier discharges and which includes:

a discharge vessel, which comprises a cover plate and a base plate which are separate at the start of the process and a frame, for holding a discharge medium in a discharge chamber of the discharge vessel, a set of electrodes (5) for producing dielectric barrier discharges in the discharge medium, and a dielectric layer between at least part of a set of electrodes (5) and the discharge medium, in which process, during a filling step which precedes closing of the discharge chamber, the cover plate of the discharge vessel is held in a raised position by a support element (1'–1"",2'–2"",15) that is arranged outside of the frame, which support element (1'–1"",2'–2"",15) is at least partially softened (15,16) by the application of heat, in order for the discharge chamber to be closed, with the result that the part (3) of the discharge vessel which has been held in a raised position is lowered, characterized in that the support element (1'–1"",2'–2"", 15), while the discharge vessel part (3) is being held in a raised position, is arranged entirely outside the discharge chamber.

2. The process according to claim 1, in which there are no softening parts within the discharge vessel during the filling step.

3. The process according to claim 1, in which the support element is merely an auxiliary means of the process, and the finished discharge lamp is separated from the support element after the production process.

4. The process according to claim 3, in which the support element (1'–1"",2'–2"",15), in order to hold the cover plate in a raised position, engages on a section of the cover plate which is provided specifically for this purpose and is removed during the production process.

5. The process according to claim 1, in which at least one and at most four support elements (1'–1"",2'–2"",15) are used.

6. The process according to claim 1, in which the support element(s) (1'–1'''',2'–2'''',15) include tube sections (15) made from a suitable softening material.

7. The process according to claim 1, in which the support element(s) (1'–1'''',2'–2'''',15) include softening parts (15) which substantially comprise SF6-glass.

8. The process according to claim 1, in which the cover plate which is held in a raised position is provided with additional weight in order to assist with the lowering operation.

* * * * *